United States Patent [19]

Zacuto

[11] 4,399,726

[45] Aug. 23, 1983

[54] CUTTING DEVICE

[76] Inventor: Victor Zacuto, 5705 Bevis Ave., Van Nuys, Calif. 91411

[21] Appl. No.: 247,842

[22] Filed: Mar. 26, 1981

[51] Int. Cl.[3] ..... B26D 3/16

[52] U.S. Cl. ..... 83/411 R; 83/415; 83/856; 83/859

[58] Field of Search ..... 83/411 R, 415, 425, 83/607–609, 856–858, 733, 859

[56] References Cited

U.S. PATENT DOCUMENTS

| | | | |
|---|---|---|---|
| 1,746,930 | 2/1930 | Clark | 83/411 R |
| 1,783,222 | 12/1930 | Collins et al. | 83/467 |
| 1,882,139 | 10/1932 | Giuffre | 83/411 R |
| 1,891,749 | 12/1932 | Conti | 83/411 R |
| 1,930,816 | 10/1933 | Manxi | 83/411 R |
| 2,516,959 | 8/1950 | Coull | 30/131 |
| 2,970,377 | 2/1961 | Olsen | 30/102 |
| 3,253,333 | 5/1966 | Keiter | 83/411 R |
| 3,807,046 | 4/1974 | Igyerto et al. | 30/92 |
| 3,834,019 | 9/1974 | Smeltzer | 30/92 |
| 4,082,025 | 4/1978 | Reinbacker | 83/411 R |

OTHER PUBLICATIONS

Cutting devices shown on pp. 416, 417, 1058, 1813, 2136, 2137 of American Mechanical Dictionary [3 vols., consecutively page-numbered], published by Hurd-+Houghton Cambridge: The Riverside Press, 1877+authored by Edward H. Knight.

*Primary Examiner*—James M. Meister
*Attorney, Agent, or Firm*—Frank L. Zugelter

[57] ABSTRACT

A plastic tubing cutting device, to be used in the field or shop, and which severs in a clean way such tubing. A mandible having a channel in which the tubing seats is pivoted by means of a handle, the tubing engaging a severing blade in an upward pivotal motion for the mandible. The mandible is pivotally mounted on a vertical member of an inverted L-shaped frame which also includes a horizontally-disposed stabilizing element. The blade is secured between the vertical member and stabilizing element. The inverted L-shaped frame is secured to a rigid frame and extends forwardly thereof, the rigid frame including laterally extending balancing members for the device. Additional features of a locking means for the device when not in use, of a safety shield for the body and eyes against flying plastic fragments, and trough and guide for tubing seated in the channel, are provided.

31 Claims, 6 Drawing Figures

CUTTING DEVICE

This invention relates to cutting devices, and is particularly directed to a device for severing plastic tubing or the like.

Presently, hand-held tools, similar to hand snips or pliers, in actuation, are used in the plumbing industry, to sever plastic tubing known as PVC [polyvinylchloride material]. Use of these types of tools indicates difficulties, awkwardness and slowness in the operation of them, when cutting PVC. The handles of the hand-held tools are pumped manually, one against the other by the user's hand and fingers. Such tools do not adapted themselves readily to the hand, because of their peculiar sizes, as also do snips or pliers, and thus are difficult to hold. The tools are awkward since their angulate handles are difficult to grasp sufficiently within the palm of a hand and thereafter actuated one against the other. These disadvantanges, coupled with the difficulty of cutting with them into the PVC thickness itself, results in a continuous problem of severing multiple numbers of lengths of PVC tubing in the field; a vexacious situation, to say the least, to the tradesman.

An object of this invention is to provide a unique and novel implement for severing PVC tubing or the like.

Another object of this invention is to provide a safe, rugged, fast-in-action, easy-operating and inexpensive tool for use in the field.

Another object of this invention is to provide a clean and unbroken or unshattered tube end at a right angle to the axis of the tubing being severed, which in turn provides for better or improved assembly of tubing in the field.

A further object of this invention is to provide a tool that can sever various sizes of plastic tubing or the like.

These and other objects and advantages of the invention will become more apparent upon a full and complete reading of the following description, appended claims thereto, and in conjunction with the accompanying drawing comprising five Figures [one sheet].

DESCRIPTION OF THE PREFERRED EMBODIMENT

Figure 1:
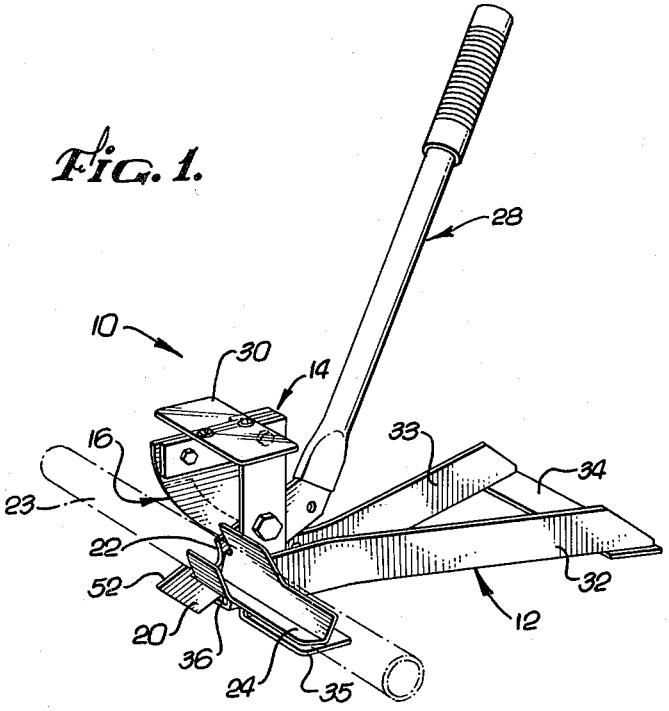
FIG. 1 is a perspective view of a cutting device embodying the invention.

Referring now to the drawing Figures in which reference characters therein correspond to the numerals hereinafter, FIG. 1 illustrates in perspective an embodiment of the invention in the form of a cutting device 10, the operation of which severs plastic tubing or the like. Cutting device 10 comprises a rigid frame 12 for stationary application, an inverted L-shaped frame 14 securely mounted to frame 12 and in which a cutting means 16 is securely mounted, a mandible 20 pivotally mounted to the inverted L-shaped frame 14, and a channel 22 incorporated within the length of the mandible 20 for introduction of a portion of a tubing 23 to be severed. A bed or trough 24 is provided in co-axial relationship with the part of the mandible's length which provides for the channel 22, for supporting the length of the tubing being cut. A pair of guides 26 [FIGS. 2, 3, 5] are spacedly mounted on the bed 24 to assist putting and holding the tubing in a proper relationship to the channel 22. Means 28, such as an actuating arm or elongated handle, is suitably securely mounted to mandible 20 for providing pivotal or other actuating motion thereto in operation of the device 10. A safety shield 30 is provided, in suitable secured fashion, to the inverted frame 14, or elsewhere if needed, to prevent flying fragments of unknowingly brittle plasticity of the tubing being cut, from injuring the operator or others.

Figure 2:
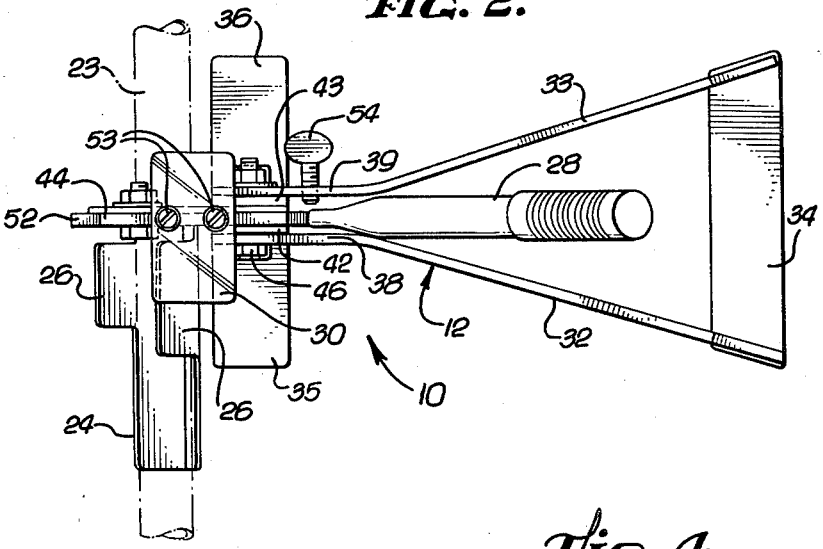
FIG. 2 is a plan view of the cutting device shown in FIG. 1.

In more particularity of this embodiment, frame 12 [FIGS. 1, 2] comprises an assembly of metal members 32, 33, 34, 35, and 36, all appropriately securely mounted together, such as by welding, so as to form a rigid frame suitable for supporting and balancing the device 10, and for stationary application upon or to a table or the like during its operation. Members 32, 33 are elongated and include vertically-aligned flat sides which form in plan view [FIG. 2] a pair of isoceles-triangled legs. Member 34 constitutes the base of such a triangular image and the rear ends of the members 32, 33 are securely mounted thereto, its flat side disposed upwardly. At the apex of such triangular image, the leg members 32, 33 remain generally in parallel geometry to form end portions or extensions 38, 39 [FIGS. 2, 5], respectively. The members 35, 36, flat sides down (and up), are respectively securely mounted to these extensions 38, 39, and laterally extend in the same direction as crossmember 34, to provide balance to the device. In this particular frame [FIG. 5], members 35, 36 are also bent upwardly, such bent portions being disposed interiorly of, and in physical engagement and securement, such as by welding, to end portions 38, 39, respectively, formed on members 32, 33, and provide proper spacing for elements interposed therebetween.

The inverted frame 14 is securely mounted to and above the frame 12, with particular elements, hereinafter described, extending forwardly of frame 12. Frame 14 comprises a pair of spaced, generally vertically disposed and parallel, rigid members or bars 42, 43. Interdisposed between members 42, 43, and extending forwardly thereof, is the cutting means 16, which in this embodiment, takes the shape of a triangle except for the configuration of its cutting edge. Locking assemblies 46 and 49, such as suitable bolts and nuts therefor, extend through apertures formed in the bars 42, 43 and in the triangular-shaped metal plate forming the cutting means 16, thereby securely mounting such plate to frame 14. Also interdisposed between members 42, 43 is a stabilizer 44, which takes the form of a bar and which extends forwardly in a horizontal relationship to such members 42, 43. Stabilizer 44 maintains the blade edge of cutting means 16 in a singular vertically disposed plane coincident to the severing plane for the tubing to be and which is being severed., i.e., to prevent tweaking of the blade. The one end or rear portion of stabilizer 44 is securely mounted to members 42, 43 by means of the locking assembly 46, while its most forwardly extending end portion is securely mounted to cutting means 16 by another locking assembly 48 extending through apertures in both the bar forming the stabilizer and in the one corner of the triangulared-shaped plate forming cutting means 16.

Figure 5:
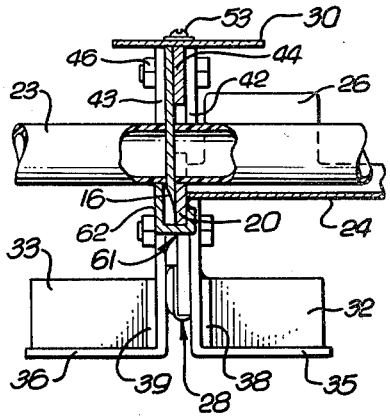
FIG. 5 is a view taken on line 5—5 of FIG. 4.
Figure 4:
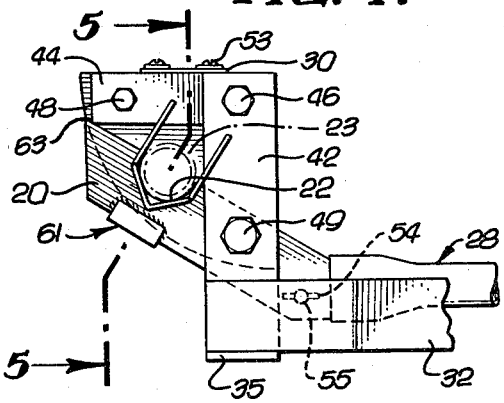
FIG. 4 is a side elevational view of the fragmentary portion of FIG. 3, but after severing action has taken place on such tubing.

Also in this embodiment, the spaced leg elements 42, 43 are extensions of the vertically disposed bent portions of the laterally extending members 35, 36, respectively [see FIGS. 4, 5]. However, these elements may be formed separately from members 35, 36, should it b desired, and suitably securely mounted, such as by welding, to elements of frame 12, or to other elements of another frame configured differently than that shown as frame 12 and to which frame 14 can be suitably and in known manner securely mounted.

The cutting means 16, formed from a metal plate of Rockwell hardness 50, includes a cutting blade or edge 50 which is openly exposed forwardly of frame 12. Blade 50 is designed to provide a slicing-like action upon tubing 23 supported in channel 22 of mandible 20, and which mandible is pivoting into such blade in the operation of device 10. The blade 50 is formed by beveling the one and exposed arcuately-shaped edge of the metal plate forming cutting element 16.

The mandible 20 comprises an elongated rigid member having formed along its upper edge 52 the channel 22, and is pivotally mounted on frame 14 for cooperative action with the cutting edge or blade 50. Mandible 20 is interdisposed between the leg elements 42, 43, and utilizes locking assembly 49 as its fulcrum. The channel 22 is located or displaced along its upper edge 52 such that in the pivotal movement of mandible 20 in relation to the exposed blade 50, in substantial physical contact therewith, the channel 20 passes completely by the blade.

The upper edge 52 of mandible 20 is in apposition with or to stabilizer 44, such being accomplished in the assembly steps for device 10. The thickness of mandible 20 forming such upper edge 52 is preferably substantially the same thickness as that of stabilizer 44. In this manner, a means to stop pivotal motion of mandible 20 is provided. It will be observed from FIG. 4, which shows the device in its position after severing of a tubing 23, that the upper edge 52 of mandible 20, immediately adjacent its end, engages or makes physical contact with stabilizer 44 adjacent its frontal bottom corner, and as referenced at 63. At such contact 63, mandible 20 can no longer pivot, while also having carried tubing 23 in channel 22 past the cutting edge 50.

Handle 28 works against frame 14 and is suitably attached to and at the rear of the mandible 20, for actuation thereof, and is generally in planar alignment therewith but preferably at an angular inclination to the longitudinal axis of mandible 20 in order to gain a better leverage upon mandible 20 during severing action upon tubing 23 seated in the channel 22.

The trough 24 is welded to a side of mandible 20 opposite to the mandible's side along which blade 50 rides or slides. Its geometrical axis is coincident or parallel to the axis of channel 22. Its length is sufficiently long for stabilizing and supporting at a right angle the length of a tubing 23 to channel 22, thereby assuring or maintaining a right-angled cut for the tubing 23. Spaced tabs or guides 26 mounted along the respective opposing side edges of trough 24 assist in putting tubing 23 quickly into trough 24 and maintain same therein at a right angle relative to the plane of channel 22. The channel 22 retains a curvature at its bottom that provides for the seating, at right angle thereto, of various sized tubing 23.

The safety shield 30 is attached atop the stabilizer 44 mounted on frame 14, such as by a pair of spaced screws 53 securely threaded within corresponding threaded holes [not shown] in the stabilizer. The length and width of shield 30, preferably transparent, is of such magnitude, measured from where cutting action takes place upon tubing 23, as to deflect the line of flight of tubing fragments that may develop from cutting action on PVC tubing or the like. PVC tubing has been know to shatter during cutting operation thereon, presumably due to an unknown brittle characteristic at the plane of severing. Flying fragments may result during such severing, and thus, the purpose of safety shield 30 becomes obvious.

Figure 3:
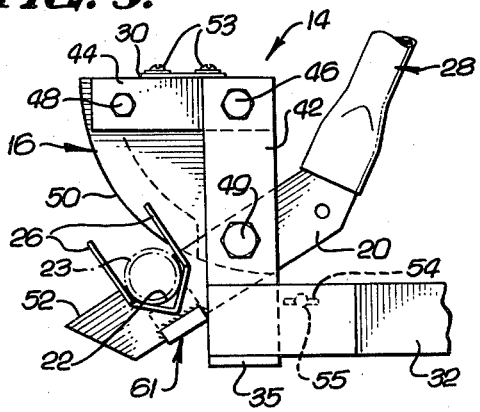
FIG. 3 is a side elevational view of a fragmentary portion of the device embodying the invention, showing plastic tubing in position for cutting action thereon.

Means to lock the device in an inoperative or closed position is provided, by a wing-nut 54 [FIG. 2] whose threaded stem projects through a corresponding threaded hole in end portion 39 of member 33, and which stem engages a notch 55 or the like [FIGS. 3, 4] in the side of mandible 20 after the latter has been pivoted into its position of closure.

Figure 6:
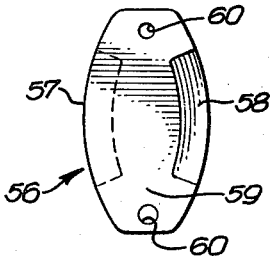
FIG. 6 is a view of a modified form of the cutting element utilized in the subject matter of the invention.

A modified blade-carrying means 56 is shown in FIG. 6. Here, such means 56 comprises a pair of blades 57, 58, respectively mounted on opposing edges of a metal plate 59 whose silouette looks similar to the profile of a football. The metal plate 59 is formed to provide a pair of holes 60 whose axes are displaced one from the other the same distance as exists in the distance between the axes of locking assemblies 48, 49. Thus, it is to be observed that means 56 has twice the life as that of cutting means 16, because the dullness of one of its blades 57, 58 is immediately replaced by the sharpness of the other of such blades, simply by rotating the means 56 on its longitudinal axis and securely re-mounting it between and by locking assemblies 48, 49 in order to present or expose the second sharp blade to channel 22. A spacer [not shown], such as a washer or the like, is provided in and at locking assembly 46, when means 56 is used, in order to maintain proper spacing between vertically disposed members 42, 43 or to maintain the proper position for the stabilizing means 44. In this embodiment, the thickness of such spacer should be the thickness of the metal plate forming cutting means 16.

Mounted, such as by welding, along and by the bottom edge of mandible 20, is a lip 61 [FIGS. 3, 4, 5]. Lip 61 is formed from metal, generally in U-shaped fashion, having a face 62 spaced from the side of mandible 20 along which the cutting edge of the blade-carrying means 16, 56 slides. Upon completion of the stroke of mandible 20, the blade's edge has entered the pocket formed by the lip's face 62 and the contiguous side of mandible 20. Such a means provides for safety of the operator's hand or fingers relative to such blade.

It should be noted that omission from the manufacture of device 10 of lip 61 does not endanger the operator's hand or fingers where the means for stopping pivotal motion for mandible 20, described above, is included in such manufacture. This holds true even though such pivotal stopping means is equated to the inoperative or closed position for device 10.

In operation of device 10, it is set stationarily, or even securely fixed, to a table or surface. The stem of the device's locking means or wing-nut 54 is unfastened or unscrewed from its locked status or notch 55 on mandible 20. Handle 28 then is elevated to pivot channel 22 free from or to a position below either means 16 or 56, which ever one is mounted in the device, to expose or present its cutting edge. A length of PVC tubing or the like in inserted into trough 24 between spaced guides or tabs 26. A desired length to be severed is manually caused to extend past mandible 20, its channel 22, and the plane of the cutting means. The tubing 23 then is hand-held securely in position by the operator's one hand and/or fingers, in the trough 24, with the tubing being at right angle to and seated across channel 22, projecting past the plane of the cutting means. Such hand and/or fingers may use guides 26 to assist in controlling the positioning of the tubing. The operator's other hand grasps handle 28 and by leverage action therewith, causes mandible 20 to pivot about its fulcrum at locking assembly 49.

In such pivoting action, the thickness of the tubing is moving in an arcuate line or curve relative to the fulcrum point of mandible 20, and the tubing's perimeter is caught at a particular point by the cutting edge. As leverage begins to be applied by the operator, the blade initially tends to make the tubing begin to collapse, without slicing into the thickness. The tubing is swinging along an arcuate path relative to the geometrical center for the pivoting mandible 20. It is to be understood that the collapsing pressure developing under actuation of the handle is not the substantial force that causes the severing of the tubing. Once the blade edge initially forces itself through the perimetal exterior of the thickness of the tubing, the collapsing pressure or force is immediately released. No further collapsing of the tubing takes place. In other words, the blade is now into such thickness and is moving through such thickness in circumferential and radial paths, as the tubing slides by the blade at a right angle thereto, until severing has been accomplished. At such severance, the blade has passed or moved through the deepest point of channel 22, and into the pocket provided by lip 61 and the one side of mandible 20. The means to stop pivotal motion of mandible 20 prevents the exposed blade edge from appearing below the bottom of such mandible, should such pocket be omitted.

The elements constituting device 10 are fabricated from suitable materials presently available in the marketplace. The flat members 32–36, 42–44, respectively, constituting the frames 12, 14 and the mandible 20 and its handle 28 can be cut to proper lengths and sizes, and made to desired configurations in known manner, from cold rolled metal bar stock. The trough 24 can be fabricated from like material. The safety shield 30 may be cut from suitable transparent plastic materials. The cutting means 16, 56 are made out of abrasive resistant steel, one kind of which is Inland AR sheet steel, 12 gauge, heat treated, and available at Earle M. Jorgensen, Co., 10650 South Alemeda St., Los Angeles, CA.

One manner of assembly of the elements of device 10 will be described. Flat members 32–36, after being cut to size, length, and properly configured, are welded together as shown in FIGS. 1 and 2. The flat members 35, 36 that have been bent to their configurations are welded to the respective extensions 38, 39 of members 32, 33. In this embodiment, the bent portions of members 35, 36 become the spaced elements 42, 43 for inverted frame 14. The holes for locking assemblies 46, 49 [and 48] have been previously provided at their proper displacements in their corresponding elements. The mandible 20, with handle 28 welded thereto, is mounted by one of such holes provided in its and which corresponds to locking assembly 49; between the vertically disposed members 42, 43. The cutting means 16 is concurrently mounted to locking assemblies 46, 49. When stabilizer 44 is included, apertures are provided in the bar forming same, and thereafter, it is readily mounted to the locking assemblies 46, 48, thereby being directly disposed above mandible 20. Locking assembly 48 assures the proper cutting positions of the cutting means and the stabilizer. Cutting means 56 is readily substituted for means 16, simply by removing locking assemblies 46, 48, 49, then means 16, then inserting means 56, and a spacer at 46, and again utilizing the locking assemblies 46, 48, 49. The hole 60 at the top of means 56 preferably is threaded and smaller than the hole at the bottom of means 56, to provide better stability in relation to stabilizer 44, when a bolt and nut constitute locking assembly 48.

In regard to the locking means comprising elements 54 and 55, it should be understood that equivalents thereof may be utilized not only directly on the mandible 20, but also elsewhere on device 10 and which will maintain the mandible 20 in a closed or inoperative position.

While I have herein shown and described a preferred embodiment of my invention, nevertheless it is to be understood that various changes and modifications may be made therein without departing from the spirit and scope of the invention, and that the invention includes all modifications and changes encompassed by and within the spirit and scope of the following claims.

What I patently claim is:

1. A device for severing plastic tubing or the like comprising a rigid frame, an inverted L-shaped frame securely mounted upon said rigid frame and extending in a forwardly direction thereon, said L-shaped frame including a horizontally disposed stabilizer and a pair of spaced vertically disposed members proximate the upper ends of and between which said stabilizer is secured, whereby said stabilizer extends forwardly relatively to said rigid frame, cutting means including a singular blade and being securely mounted to and proximate a forward end of said stabilizer and to and proximate a lower end of said pair of spaced vertically disposed members whereby said blade is exposed in a generally forward direction relative to said rigid frame, balancing members included in and extending laterally of said rigid frame and being disposed generally below said pair of spaced vertically disposed members, and a mandible including a channel therein and being pivotally mounted upon said pair of vertically disposed members whereby the channel cooperatively acts with said singular blade in operation of the device.

2. The device of claim 1 including means for pivoting said mandible operatively connected thereto.

3. The device of claim 2 including means formed on the length of said mandible in apposition to said stabilizer for abutment therewith for stopping upward pivotal motion for said mandible.

4. The device of claim 3 including a trough securely mounted to said mandible for seating a tubing to be severed in the operation of the device.

5. The device of claim 2 including a trough securely mounted to said mandible for seating a tubing to be severed in the operation of said device.

6. The device of claim 5 including at least one guide mounted on said trough for maintaining positioning of the tubing during its severance operation.

7. The device of claim 2 including a lip means mounted on said mandible for pocketing the blade upon completion of the pivotal motion of said mandible.

8. The device of claim 2 including means for locking said mandible in a closed or inoperative position.

9. The device of claim 1 including means formed on the length of said mandible in apposition to said stabilizer for abutment therewith for stopping upward pivotal motion for said mandible.

10. The device of claim 9 including a trough securely mounted to said mandible for seating a tubing to be severed in the operation of the device.

11. The device of claim 9 including a lip means mounted on said mandible for pocketing the blade upon completion of the pivotal motion of said mandible, and means for locking said mandible in a closed or inoperative position.

12. The device of claim 9 including means for locking said mandible in a closed or inoperative position.

13. The device of claim 10 including a lip means mounted on said mandible for pocketing the blade upon completion of the pivotal motion of said mandible.

14. The device of claim 10 including at least one guide mounted on said trough for maintaining positioning of the tubing therein during its severance operation.

15. The device of claim 13 including at least one guide mounted on said trough for maintaining positioning of the tubing therein during its severance operation.

16. The device of claim 15 including means for locking said mandible in a closed or inoperative position.

17. In a device for cutting tubing or the like and including a rigid frame, the improvement comprising an inverted L-shaped frame securely mounted upon said rigid frame and extending in a forwardly direction thereon, said L-shaped frame including a horizontally disposed stabilizer and a pair of spaced vertically disposed members proximate the upper ends of and between which said stabilizer is secured, whereby said stabilizer extends forwardly relatively to said rigid frame, cutting means including a singular blade and being securely mounted to and proximate a forward end of said stabilizer and to and proximate a lower end of said pair of spaced vertically disposed members whereby said blade is exposed in a generally forward direction relative to said rigid frame, balancing members included in and extending laterally of said rigid frame and being disposed generally below said pair of spaced vertically disposed members, and a mandible including a channel therein and being pivotally mounted upon said pair of vertically disposed members whereby the channel cooperatively acts with said singular blade in operation of the device.

18. The improvement of claim 17 including means for pivoting said mandible operatively connected thereto.

19. The improvement of claim 18 including a trough securely mounted to said mandible for seating a tubing to be severed in the operation of the device.

20. The improvement of claim 17 including means formed on the length of said mandible in apposition to said stabilizer for abutment therewith for stopping upward pivotal motion for said mandible.

21. The improvement of claim 20 including a trough securely mounted to said mandible for seating a tubing to be severed in the operation of the device.

22. The improvement of claim 18 including a lip means mounted on said mandible for pocketing the blade upon completion of the pivotal motion of said mandible.

23. The improvement of claim 18 including means for locking said mandible in a closed or inoperative position.

24. The improvement of claim 18 including means formed on the length of said mandible in apposition to said stabilizer for abutment therewith for stopping upward pivotal motion for said mandible.

25. The improvement of claim 24 including a trough securely mounted to said mandible for seating a tubing to be severed in the operation of the device.

26. The improvement of claim 24 including means for locking said mandible in a closed or inoperative position.

27. The improvement of claim 24 including a lip means mounted on said mandible for pocketing the blade upon completion of the pivotal motion of said mandible, and means for locking said mandible in a closed or inoperative position.

28. The improvement of claim 25 including at least one guide mounted on said trough for maintaining positioning of the tubing therein during its severance operation.

29. The improvement of claim 25 including a lip means mounted on said mandible for pocketing the blade upon completion of the pivotal motion of said mandible.

30. The improvement of claim 29 including at least one guide mounted on said trough for maintaining positioning of the tubing therein during its severance operation.

31. The improvement of claim 30 including means for locking said mandible in a closed or inoperative position.

* * * * *